US007409950B2

(12) United States Patent
Ellig et al.

(10) Patent No.: US 7,409,950 B2
(45) Date of Patent: Aug. 12, 2008

(54) FALL AWAY ARROW REST SYSTEM

(75) Inventors: Michael J. Ellig, Bozeman, MT (US); Roland K. Barner, Bozeman, MT (US)

(73) Assignee: Ripcord Technologies, Inc., Dillon, MT (US)

( * ) Notice: Subject to any disclaimer, the term of this patent is extended or adjusted under 35 U.S.C. 154(b) by 437 days.

(21) Appl. No.: 11/295,218

(22) Filed: Dec. 6, 2005

(65) Prior Publication Data

US 2006/0157038 A1 Jul. 20, 2006

Related U.S. Application Data

(60) Provisional application No. 60/645,362, filed on Jan. 19, 2005.

(51) Int. Cl.
*F41B 5/22* (2006.01)

(52) U.S. Cl. ..... 124/44.5

(58) Field of Classification Search ..... 124/24.1, 124/25.6, 44.5

See application file for complete search history.

(56) References Cited

U.S. PATENT DOCUMENTS 5,634,455 A * 6/1997 Troncoso ..... 124/44.5
D384,723 S * 10/1997 Jessee ..... D22/107
5,673,678 A * 10/1997 Savage ..... 124/44.5
5,678,530 A * 10/1997 Van Drielen ..... 124/44.5
5,685,287 A * 11/1997 Greywall ..... 124/44.5
5,722,381 A * 3/1998 Mizek ..... 124/44.5
5,743,245 A * 4/1998 Mizek ..... 124/44.5
D396,519 S * 7/1998 Jessee ..... D22/107
D397,402 S * 8/1998 Jessee ..... D22/107
5,855,200 A * 1/1999 Jessee ..... 124/44.5
5,896,849 A * 4/1999 Branthwaite et al. ..... 124/44.5
5,915,369 A * 6/1999 Sheliga ..... 124/44.5
5,944,005 A * 8/1999 Schiff ..... 124/44.5
5,950,610 A * 9/1999 Troncoso ..... 124/44.5
5,960,779 A * 10/1999 Jessee et al. ..... 124/44.5
5,992,402 A * 11/1999 Vyprachticky ..... 124/44.5

(Continued)

OTHER PUBLICATIONS

Hunter's Friend the Bowhunter's Pro-Shop, *QAD Ultra-Rest Drop Away Arrow Rest* (Internet advertisement printout (black & white, 4 pages)), date unknown, location unknown.

(Continued)

*Primary Examiner*—John Ricci
(74) *Attorney, Agent, or Firm*—Husch Blackwell Sanders LLP

(57) ABSTRACT

The present invention is directed to a fall away arrow rest system for use with a compound bow having a string. The arrow rest system is adapted to support a shaft of an arrow while a tail section of the arrow engages with the string for shooting of the arrow. The arrow rest includes a housing, a rotatable shaft having a first portion mounted with and supported by the housing and a second portion extending from the housing, a launcher and a pair of arms defining a channel therebetween for accepting the arrow shaft, an activator operative to selectively urge rotation of the rotatable shaft and movement of the launcher from an upright arrow support position to a lowered position, and including a locking component moveable from an engaging position to releasably lock the position of the rotatable shaft when the launcher is at the upright arrow support position, and a disengaging position.

7 Claims, 10 Drawing Sheets

U.S. PATENT DOCUMENTS

| | | | | |
|---|---|---|---|---|
| 6,021,769 | A * | 2/2000 | Troncoso | 124/44.5 |
| 6,039,036 | A * | 3/2000 | Padilla | 124/44.5 |
| 6,044,832 | A * | 4/2000 | Piersons, Jr. | 124/44.5 |
| 6,050,251 | A * | 4/2000 | Harwath et al. | 124/44.5 |
| 6,089,216 | A * | 7/2000 | Harwath et al. | 124/44.5 |
| 6,142,134 | A * | 11/2000 | Meeks | 124/44.5 |
| 6,178,959 | B1 * | 1/2001 | Troncoso et al. | 124/44.5 |
| 6,276,352 | B1 * | 8/2001 | Harris et al. | 124/44.5 |
| 6,363,924 | B1 * | 4/2002 | Adams, Jr. | 124/44.5 |
| RE38,096 | E * | 4/2003 | Branthwaite et al. | 124/44.5 |
| 6,561,174 | B1 * | 5/2003 | Afshari | 124/44.5 |
| 6,561,175 | B1 * | 5/2003 | Tidmore | 124/44.5 |
| 6,595,195 | B1 * | 7/2003 | Barner et al. | 124/44.5 |
| 6,615,813 | B1 * | 9/2003 | Troncoso et al. | 124/44.5 |
| 6,634,349 | B2 * | 10/2003 | Mizek et al. | 124/44.5 |
| 6,637,419 | B1 * | 10/2003 | Troncoso et al. | 124/44.5 |
| 6,662,796 | B2 * | 12/2003 | St. Cyr | 124/44.5 |
| 6,679,241 | B2 * | 1/2004 | Proctor | 124/44.5 |
| 6,681,753 | B2 * | 1/2004 | Afshari | 124/44.5 |
| 6,681,754 | B1 * | 1/2004 | Angeloni | 124/44.5 |
| 6,684,871 | B1 * | 2/2004 | Troncoso et al. | 124/44.5 |
| 6,688,296 | B1 * | 2/2004 | Greywall | 124/44.5 |
| 6,688,297 | B1 * | 2/2004 | Clague | 124/44.5 |
| 6,725,851 | B1 * | 4/2004 | Graf | 124/44.5 |
| 6,739,321 | B1 * | 5/2004 | Puchlerz | 124/44.5 |
| 6,742,510 | B2 * | 6/2004 | Troncoso, Jr. | 124/44.5 |
| 6,772,747 | B1 * | 8/2004 | Vastag | 124/44.5 |
| 6,776,149 | B1 * | 8/2004 | Beeks | 124/44.5 |
| 6,782,881 | B2 * | 8/2004 | Mizek et al. | 124/44.5 |
| 6,789,535 | B1 * | 9/2004 | McIntyre | 124/44.5 |
| 6,789,536 | B1 * | 9/2004 | Summers | 124/44.5 |
| 6,792,932 | B2 * | 9/2004 | Musacchia, Jr. | 124/44.5 |
| 6,820,607 | B1 * | 11/2004 | Terry | 124/44.5 |
| 6,823,856 | B2 * | 11/2004 | Rager | 124/44.5 |

OTHER PUBLICATIONS

Quality Archery Designs, *Ultra-Rest The Ultimate Drop-Away Rest* (Internet advertisement printout (black & white, 8 pages)), date unknown, Madison Heights, Virginia.

Ripcord Arrow Rest, *Fall-Away Arrow Rest* (color brochure (mostly brown and white with black lettering, 2-page, front and back, 8.5×11 glossy paper)), date unknown, Dillon, Montana.

Ripcord Fall-Away Rest, *Fall-Away Rest* (color insert (mostly blue w/ white clouds, 2-page, front & back on 6.5×4.5 glossy paper with rounded corners)), date unknown, Dillon, Montana.

Dakota Archery Products, Inc., *Dakota Confidence 7 Arrow Holders* (4-page color brochure, mostly burgundy border, 4-page, front & back on 11×17 glossy paper)), date unknown, Madison, South Dakota.

* cited by examiner

FALL AWAY ARROW REST SYSTEM

CROSS-REFERENCE TO RELATED APPLICATIONS

This application claims priority to U.S. Provisional Pat. App. Ser. No. 60/645,362, filed Jan. 19, 2005, which document is hereby incorporated by reference to the extent permitted by law.

BACKGROUND OF THE INVENTION

Arrow rests for compound bows provide a steadying surface for the shaft of an arrow as the user prepares to fire the arrow at a target. More specifically, arrow rest launchers allow the user to make aiming adjustments based on the surrounding environmental conditions (e.g., wind speed and direction) while reducing the tendency of dropping of the arrow by the user or otherwise losing selected arrow positioning necessary for good aiming and maintaining the tail of the arrow in proper contact with the string of the bow for firing thereof.

One common problem with arrow rest launchers is that the fletching of the arrow, necessary for proper aerodynamic properties, may contact a launcher when firing and change the desired trajectory of the arrow. So-called "drop away" arrow rests and the like have been developed to reduce the tendency of fletching contacting the launcher when an arrow is fired. The movement of the launcher out of the way of the fletching takes place substantially after the arrow has been fired (by releasing the bow string) but before the tail region of the arrow where the fletching is located has passed the launcher. Traditional fall away rests lift the arrow into position as the bow is drawn. This eliminates the possibility of holding the arrow securely in the prelaunch position. Lifting the arrow as it is drawn also caused the arrow to "hop" off the rest when the archer reaches full draw if he has drawn the bow too quickly as is often the case when someone excitedly draws his bow on a game animal. Traditional drop away arrow rests are complicated in design and thus are prone to failure in the varied environmental conditions in which compound bows are often used. For instance, many hunters find themselves in many types of weather situations due to the fact that "big game" are located in mountainous terrain or other cold weather habitats. An arrow rest should be reliable and easy to use even in adverse weather conditions. Nevertheless, some drop away arrow rests only engage the "drop away" feature when the bow string is released at a certain rate or is "snapped back" when firing an arrow. The components necessary to effect this type of drop away feature are susceptible to failure in temperature extremes, and complicate the firing procedure for the user.

SUMMARY OF THE INVENTION

The present invention is directed to a fall away arrow rest system for use with a compound bow having a string. The arrow rest system is adapted to support a shaft of an arrow while a tail section of the arrow engages with the string for shooting of the arrow. The arrow rest includes a housing having a cavity and being adapted for coupling with the bow, a rotatable shaft having a first portion mounted with and supported by the housing and a second portion extending from the housing, a launcher having a base affixed on the second portion of the rotatable shaft and a pair of arms extending from the base in a direction away from the rotatable shaft, the arms defining a channel therebetween for accepting the arrow shaft, an activator disposed within the housing cavity and coupled with the rotatable shaft, the activator being operative to selectively urge rotation of the rotatable shaft and movement of the launcher from an upright arrow support position to a lowered position, and including a locking component moveable from an engaging position to releasably lock the position of the rotatable shaft when the launcher is at the upright arrow support position, and a disengaging position, a cord secured to the locking component of the activator and extending to a point exterior of the housing for coupling with the string of the compound bow. Further, when the locking component is in the engaging position, pulling of the string causes movement of the cord coupled therewith to disengage the locking component, and thereafter upon releasing of the string to shoot an arrow engaging with the string and resting on the launcher, the activator moves the launcher from the upright arrow support position to a lowered position. Moreover, when the locking component is in the disengaging position and the launcher is not in the upright arrow support position, pulling of the string with a force sufficient to overcome the rotational urging of the activator causes movement of the cord coupled therewith and movement of the launcher towards the upright arrow support position.

DETAILED DESCRIPTION OF THE INVENTION

Figure 1:
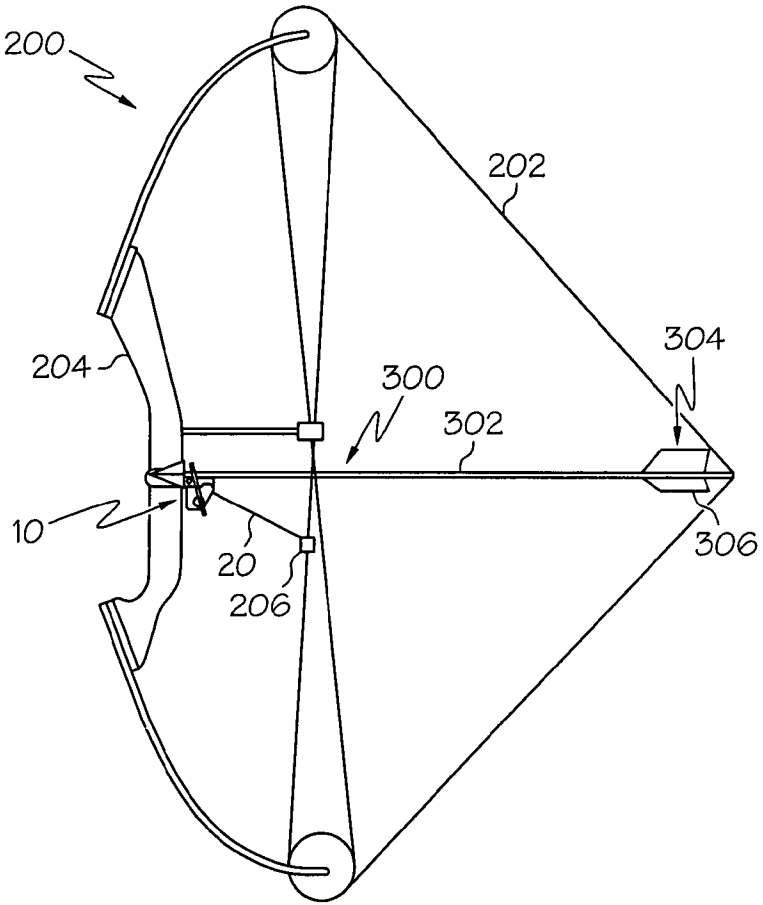
FIG. 1 illustrates a fall away arrow rest in accordance with one embodiment of the present invention in use with a compound bow.
Figure 2:
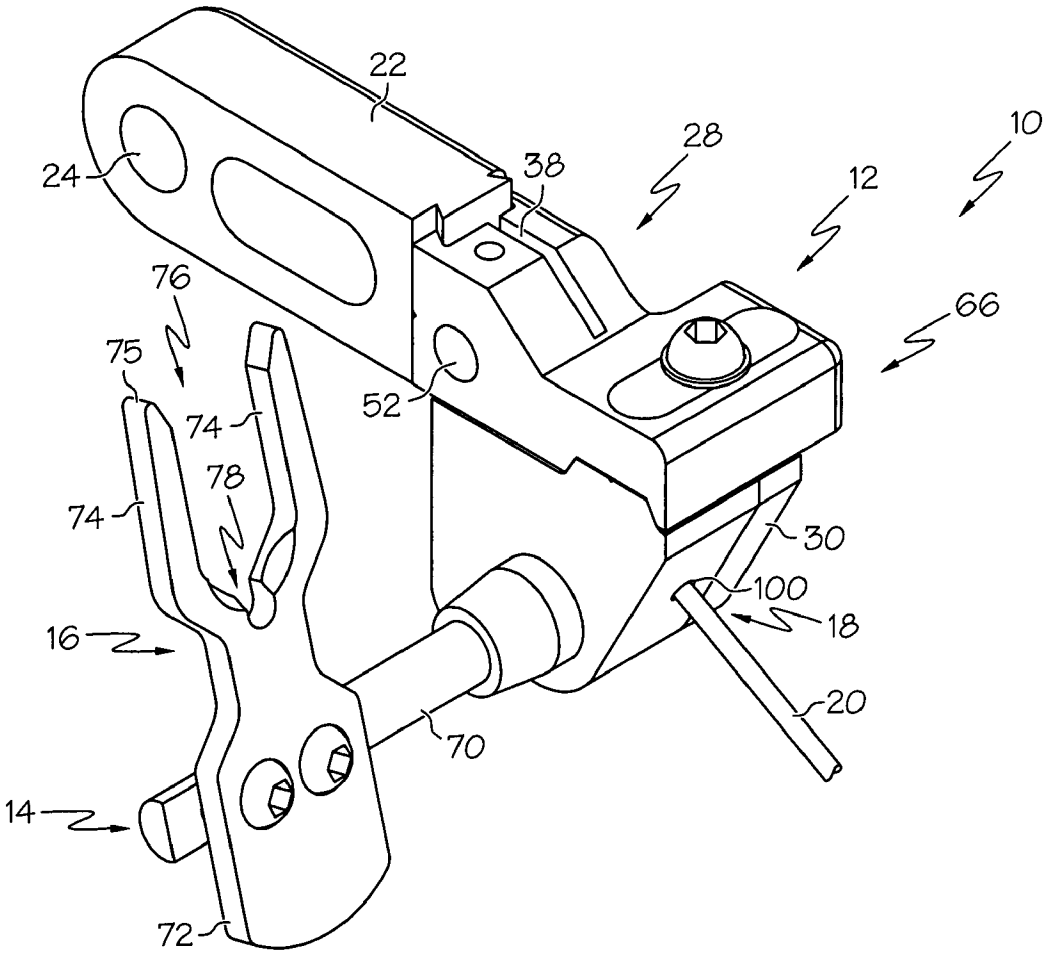
FIG. 2 is a perspective view of the fall away arrow rest with the launcher in the upright arrow support position.
Figure 3:
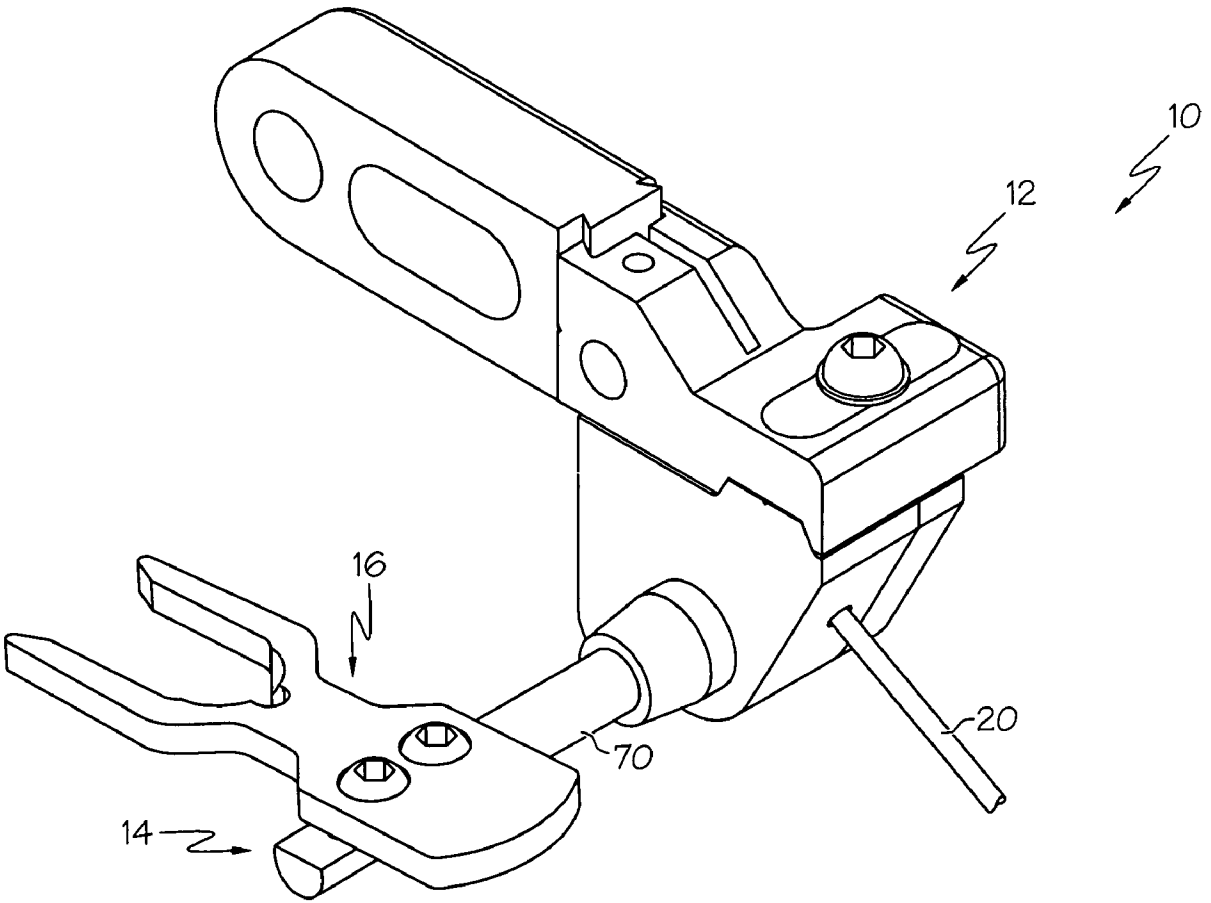
FIG. 3 is a partial perspective view of the fall away arrow rest with the launcher in the lowered position.

With specific reference to the figures, and initially FIG. 1, there is shown a fall away arrow rest 10 for use with a compound bow 200 having a string 202 for shooting an arrow 300. FIG. 2 presents are more detailed illustration of the fall away arrow rest 10, which generally includes a housing 12 for attachment with compound bow 200, a shaft 14 rotatably mounted with housing 12 and extending laterally therefrom, a launcher 16 affixed to shaft 14 for rotation therewith, an activator 18 (best seen in FIGS. 4 and 8-10) disposed within housing 12 and inducing rotation of shaft 14 to cause launcher 16 movement upon releasing of bow string 202 or when the user reduces the pulling force applied to bow string 202, and a cord 20 connected with activator 18 and with bow string 202 to control unlocking of the activator when launcher 16 is at an upright arrow support position based on the bow string activity. The arrow rest 10 is used by placing a shaft 302 of an arrow 300 on launcher 16 and engaging a tail section 304 of arrow 300 with bow string 202 so that bow 200 fires or shoots arrow 300 in a longitudinal direction forwardly of launcher 16. FIG. 1 shows bow 200 being in a vertical orientation where arrow 300 aligned in the longitudinal direction on launcher 16 would be fired horizontally. Arrow 300 may obviously be fired from any number of orientations depending on the desired flight path. Activator 18 is configured to move launcher 16 from an upright arrow support position shown in FIG. 2 and commonly used when firing arrow 300 to a lowered position shown in FIG. 3 where launcher 16 is rotated downwardly out of the way of arrow 300 that has been fired.

Figure 6:
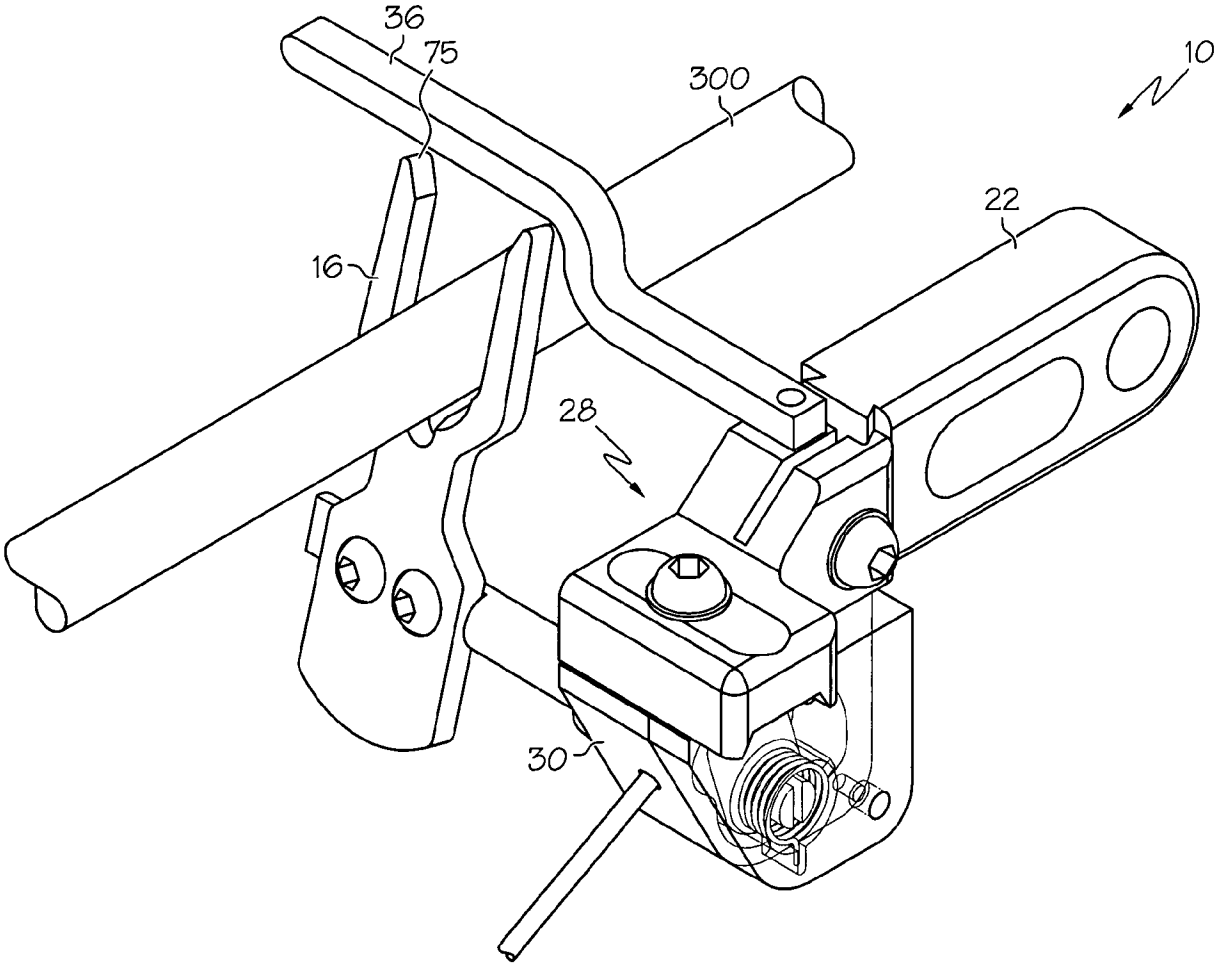
FIG. 6 is a perspective view of another embodiment of the fall away arrow rest having a launcher with raised lateral portions to aid in arrow retainment and showing the containment arm.
Figure 7B:
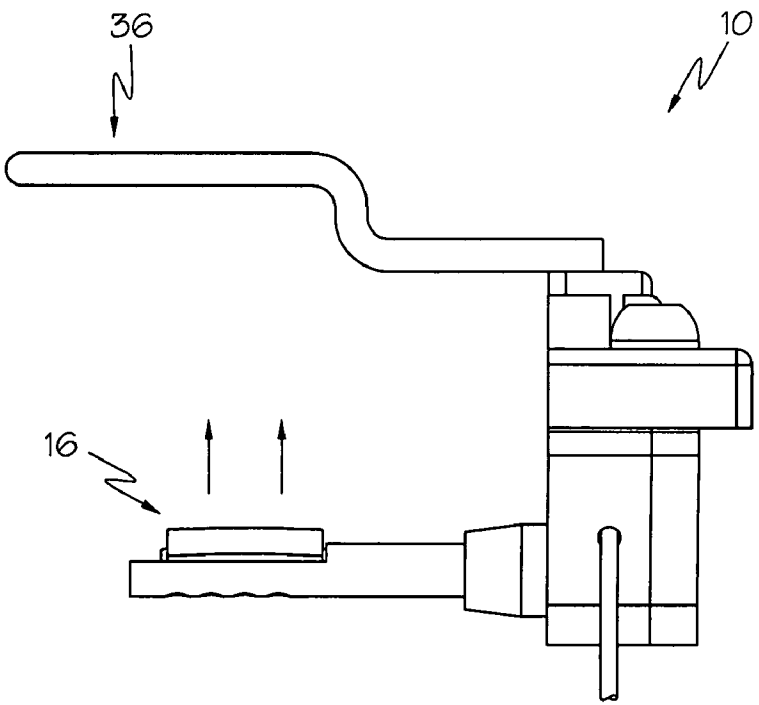
FIGS. 7A and 7B are perspective views of the embodiment of the fall away arrow rest shown in FIG. 6, with FIG. 7A showing the launcher in the upright arrow support position and FIG. 7B showing the launcher in the lowered position.

Housing 12, best seen in FIGS. 2-5, has a mounting component 22 with a horizontally-oriented threaded aperture 24 for accepting a fastener (not shown) to secure housing 12 with a frame 204 of compound bow 200. An intermediate component 28 and a support component 30 also make up housing 12. The mounting component 22 has a dovetail 32 that slides within a vertically-oriented slot 34 of intermediate component 28. A containment arm 36, seen in FIGS. 6-7B, is secured onto an upper surface 38 of intermediate component 28. The containment arm 36 has a first lateral portion 40 pivotably mounted with upper surface 38, an upward bend 42 and a second lateral portion 44 extending from the bend 42. The containment arm 36 is configured for rotation generally about a vertical axis between a nonuse position where arm 36 overlies mounting component 22 and a working position generally 90 degrees from the first position where arm 36 directly overlies launcher 16 or overlies at a position immediately forwardly or rearwardly from launcher 16. The function of containment arm 36 is to prevent the user from accidentally jarring arrow 300 off of launcher 16 when moving bow 200. The containment arm 36 typically is placed in the nonuse position when loading arrow 300 onto launcher 16 and moved to the working position overlying arrow 300 when arrow containment is desired. In situations where arrows are repeatedly and quickly loaded onto launcher for rapid firing, or when the user is not concerned about arrow containment, (e.g., at a practice range where the user is stationary) the user may desire to keep containment arm 36 at the nonuse position.

Figure 4:
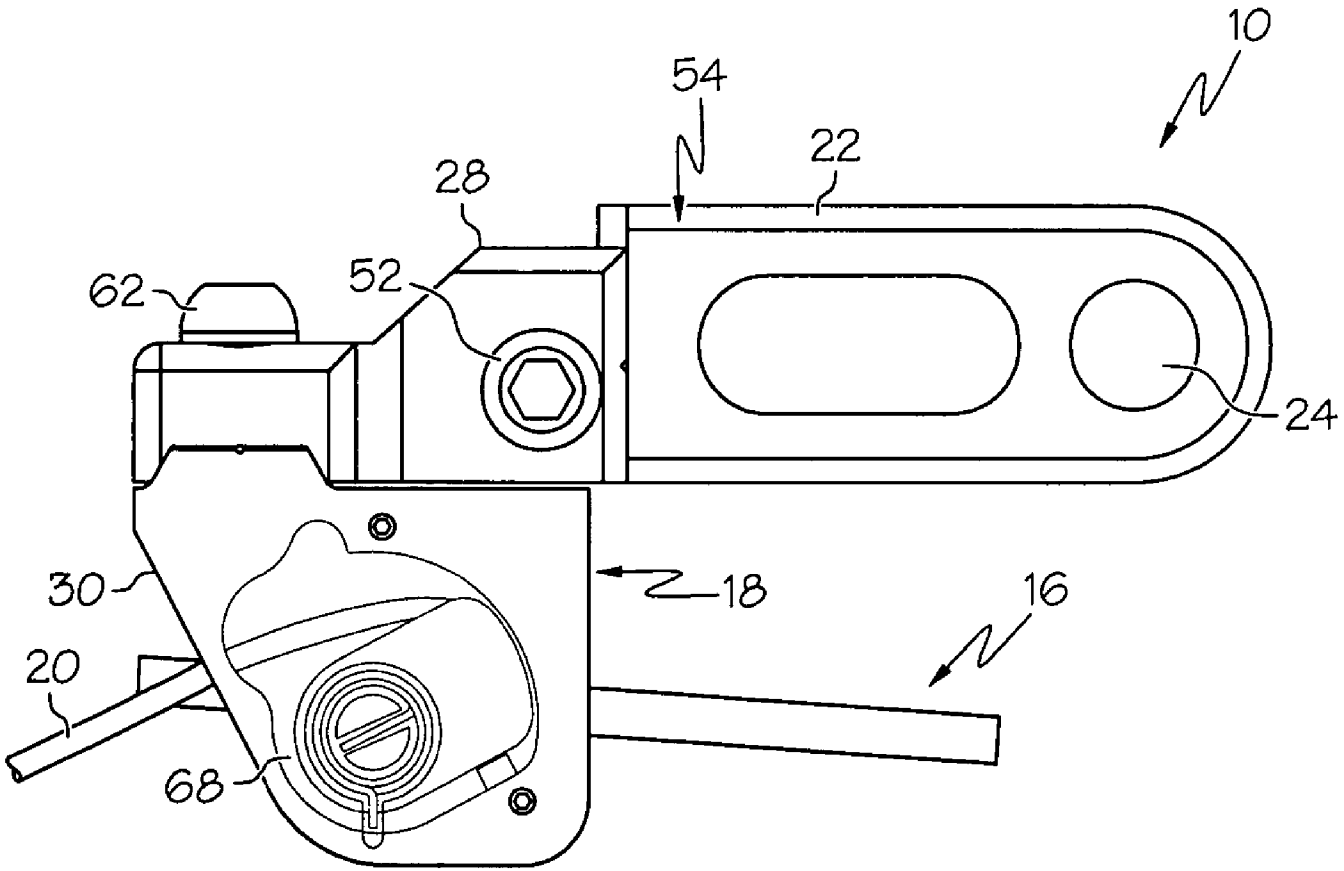
FIG. 4 is a right side elevational view of the fall away arrow rest.
Figure 5:
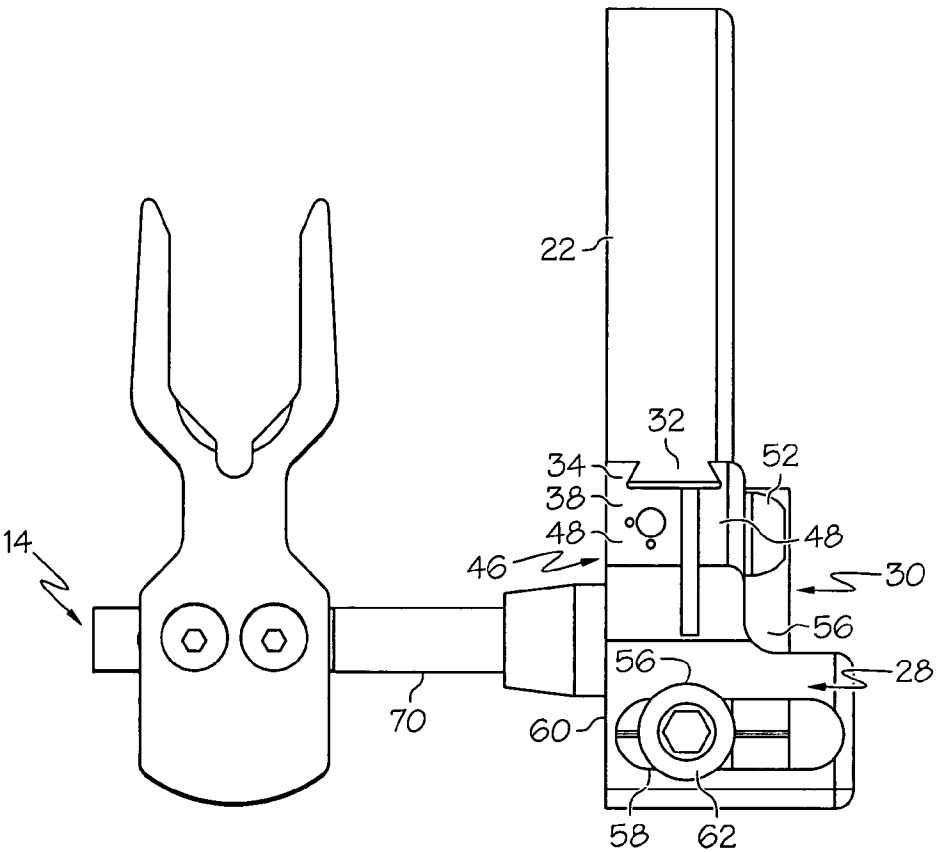
FIG. 5 is a partial top plan view of the fall away arrow rest showing particular details of the housing.

Rotatable shaft 14, to which launcher 16 is affixed, extends from support component 30 of housing 12. Because mounting component 22 is rigidly secured with bow frame 204, the sliding connection between dovetail 32 of mounting component 22 and vertically-oriented slot 34 of intermediate component 28 controls the vertical positioning of the remainder of arrow rest 10, including launcher 16, with respect to bow 200. Vertical positioning of launcher 16 may be necessary to adjust for proper arrow tuning. A forward portion 46 of intermediate component 28 is bifurcated along a vertical plane into a pair of arms 48 which together form slot 34. A horizontally-oriented threaded aperture 50 extends through arms 48 and accepts a fastener 52. Tightening of fastener 52 within threaded aperture 50 causes arms 48 to move laterally toward one another and the width of slot 34 to constrict to fixedly position dovetail 32 at a selected height within slot 34 for desired vertical positioning relative to bow 200. A set of spaced marks 54 may be provided on intermediate component 28, as seen in FIG. 4, so that vertical positioning relative to mounting component 22 rigidly secured to bow 200 can be determined.

Intermediate component 28 slides laterally or horizontally on an upper surface 56 of support component 30. A slot 58 elongated in the lateral direction extends vertically through a rearward portion 60 of intermediate component 28 and is configured for accepting a fastener 62 therein. A vertically-oriented threaded aperture (not shown) is formed in upper surface 56 of support component 30 beneath slot 58 for receiving a portion of fastener 62 extending beneath slot 58. Tightening of fastener 62 extending through slot 58 into the threaded aperture in support component 30 causes a head of fastener 62 to abut and push downwardly on upper surface 56 of intermediate component 28 to compress intermediate component 28 against support component upper surface 56 and cause frictional engagement to inhibit sliding movement of intermediate component 28 relative to support component 30. This action fixes the lateral position of support component 30 relative to intermediate component 28 which, through mounting component 22, always maintains the same lateral position with respect to bow 200. Therefore, the lateral position of launcher 16 with respect to bow 200 may be selected, for instance, to ensure that fletching 306 formed near tail section 304 of arrow 300 does not contact intermediate component 28, mounting component 22, or a portion of bow 200, or to select the extent of overhang of containment arm 36 over arrow 300 resting on launcher 16 when containment arm 36 is in the working position. Loosening of fastener 62 to the extent necessary to alleviate the compression force applied to intermediate component 28 allows component 28 to slide laterally along support component upper surface 56 to change the horizontal position of support component 30 relative to intermediate component 28 and bow 200. A set of spaced marks 66 may be provided on intermediate component 28 so that lateral positioning of support component 30 relative to intermediate component 28 can be determined.

Shaft 14 has a first portion 68 rotatably mounted within housing 12 and extends transversely out of housing 12 in a cantilevered fashion to a second portion 70 where launcher 16 is mounted. Launcher 16 has a base 72 which is rigidly attached to rotatable shaft second portion 70 and a pair of arms 74 extending from base 72 in a direction away from shaft 14 to terminal ends 75 thereof. Arms 74 define a channel 76 therebetween and converge at base 72 to form a notch 78 where arrow 300 may rest.

Figure 8:
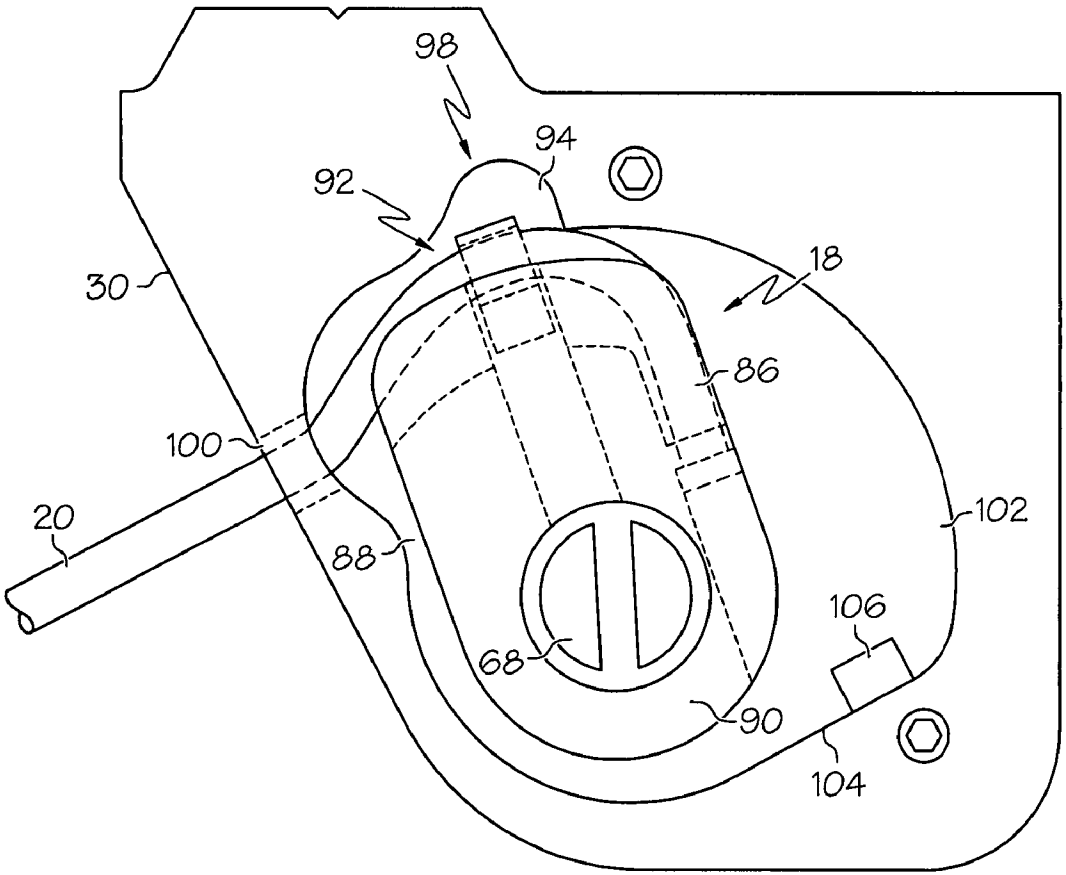
FIG. 8 is a close up right side elevational view of the support component of the housing showing the activator in a first position where the locking component is engaged and the launcher is in the upright arrow support position.
Figure 9:
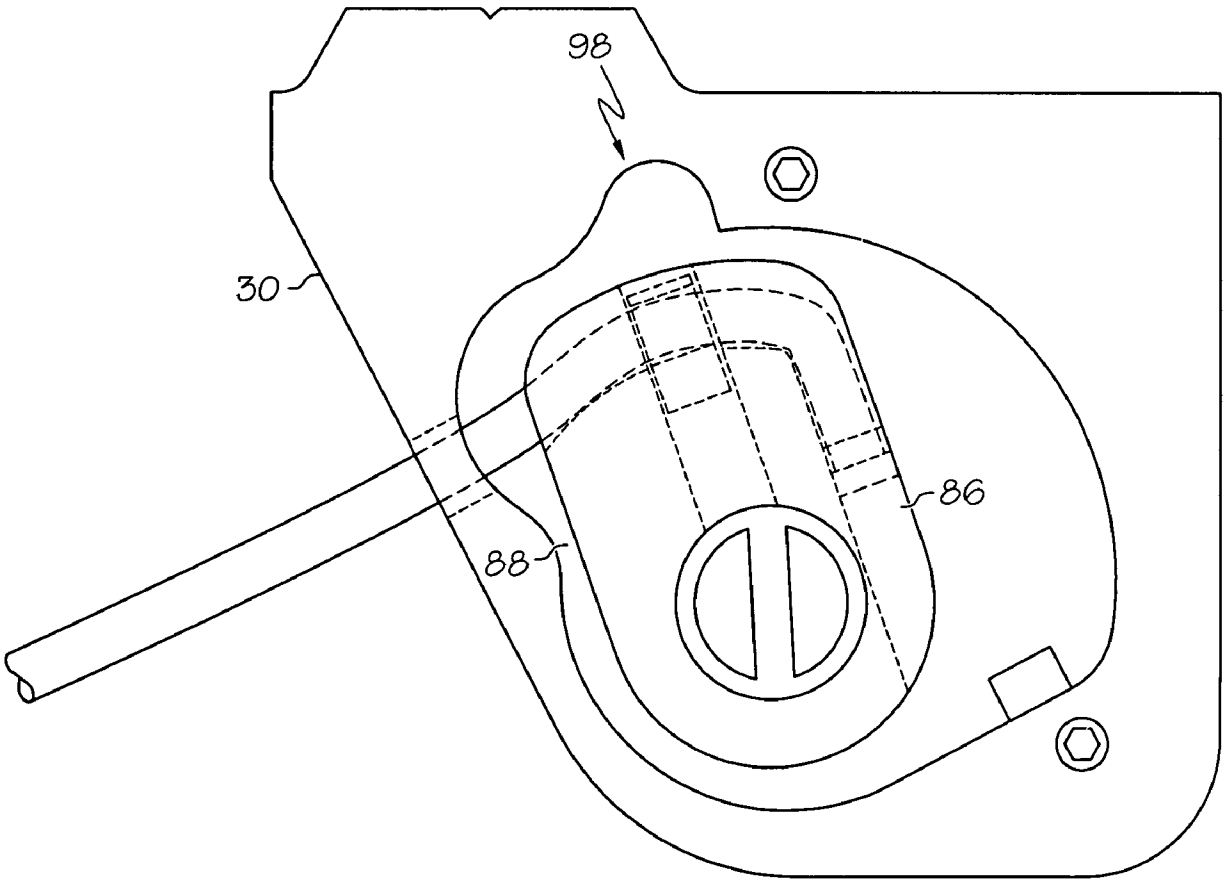
FIG. 9 is another close up right side elevational view of the support component of the housing showing the locking component disengaged.
Figure 10:
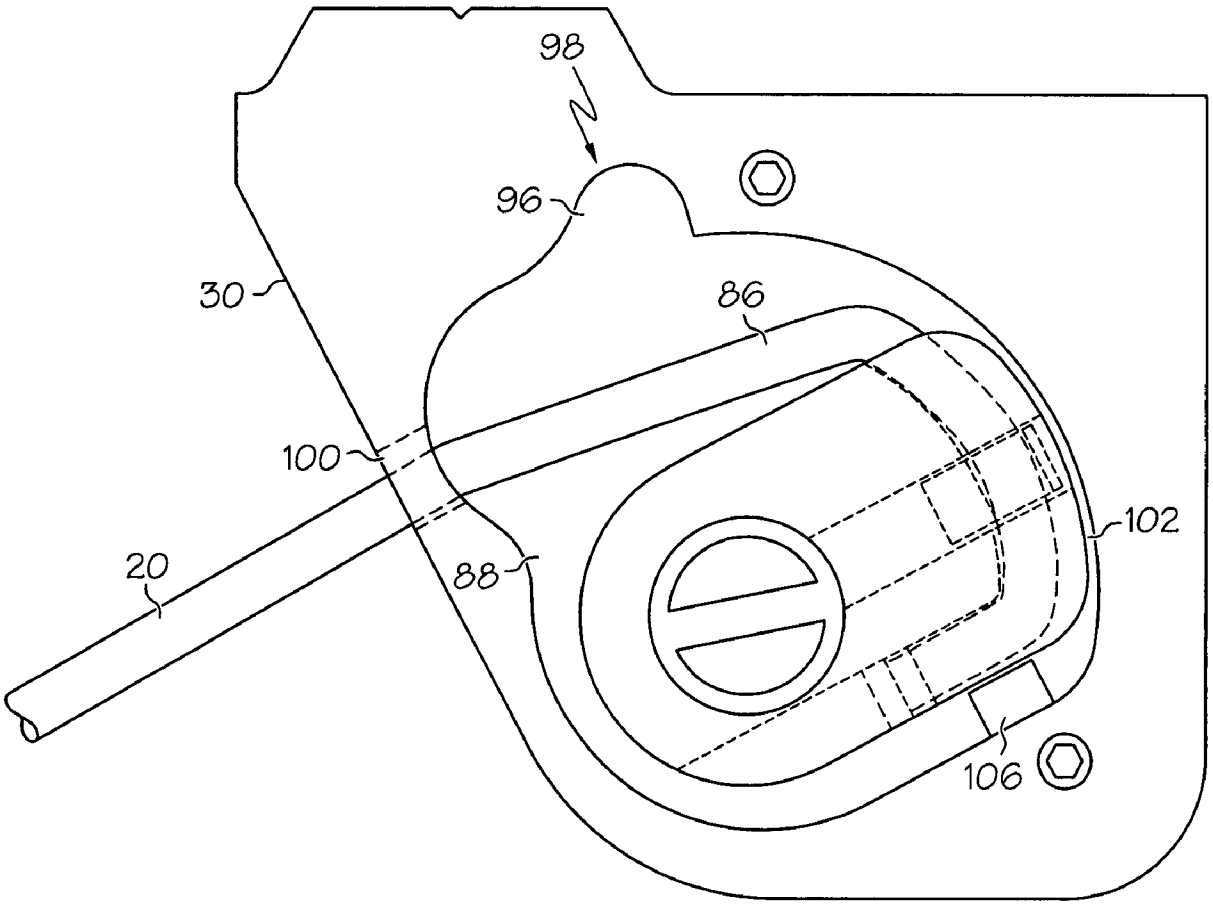
FIG. 10 is another close up right side elevational view of the support component of the housing showing the locking component in the second position where the locking component is disengaged and the launcher is in the lowered position.

The activator 18 and actions provided by movement of cord 20 will now be described with continuing reference to the aforementioned figures, and with particular reference to FIGS. 8-10. A cavity 86 is formed in support component 30 of housing 12 into which first portion 68 of shaft 14 extends and within which activator 18 is housed. Activator 18 includes a body 88 rigidly affixed onto shaft first portion 68, a torsional biasing element 90, such as a torsion spring, affixed to both support component 30 and shaft first portion 68 to urge rotation of shaft 14 relative to housing 12, and a locking component 92 to regulate rotation of shaft 14 provided by activator 18. Locking component 92 includes a stop 94 movable linearly within a slot (not shown) of body 88 and a stop biasing element (not shown), such as a compression spring, for urging a portion of stop 94 out of body 88. The portion of stop 94 that extends out of body 88 provides the locking feature for activator 18 by abutting a contact surface 96 of a notch 98 formed in housing cavity 86, as seen in FIG. 8. Through the rotational urging of shaft 14 (and therefore body 88 of activator 18 affixed thereto) provided by biasing element 90, stop 94 is engaged with notch 98 and only becomes disengaged through retraction of stop 94 out of notch 98 at least substantially fully into body 88, as seen in FIG. 9. Retraction of stop 94, by a force applied to stop 94 that is directly radially inwardly towards shaft 14, must be sufficient to overcome frictional engagement between stop 94 and contact surface 96 and force of stop biasing element in body 88. This retraction force is provided by attaching cord 20 to stop 94 and having cord extend through cavity 86 through a passageway 100 out of housing 12 for coupling with bow string 202 via a clip 206. Passageway 100 may be positioning a sufficient lateral distance from launcher so that cord 20 does not interfere with the movement of arrow 300 fired from launcher 16. The exit point of passageway 100 out of housing 12 directs the pulling force applied to cord 20 by drawn bow string 202 to be a force vector having a component directed radially inwardly towards shaft 14, thereby retracting stop 94 into body 88 towards shaft 14. Disengaging of locking component 92 (shown in FIG. 8) enables, upon releasing of the tension or pulling force applied to cord 20, torsional biasing element 90 to cause rotation of shaft 14 and body 88 affixed thereto. Body 88 rotates through cavity 86 from a first position shown in FIGS. 8 and 9 towards a second position shown in FIG. 10 under the influence of torsional biasing element 90. Cavity 86 has an arcuate sliding surface 102 which stop 94 freely slides against once stop 94 clears notch 98 and body 88 begins rotation towards the second position. Rotation of body 88 and shaft 14 to the second position is complete when body 88 reaches rotation limiting wall 104 of cavity 86. A rubber damper 106 or similar object may be placed on rotation limiting wall 104 to reduce contact noise and cushion body 88 when reaching wall 104. When activator body 88 is in the first position, shaft 14 positions launcher 16 at the upright arrow support position, and when activator body 88 is in the second position, shaft positions launcher 16 at the lowered position.

Figure 7A:
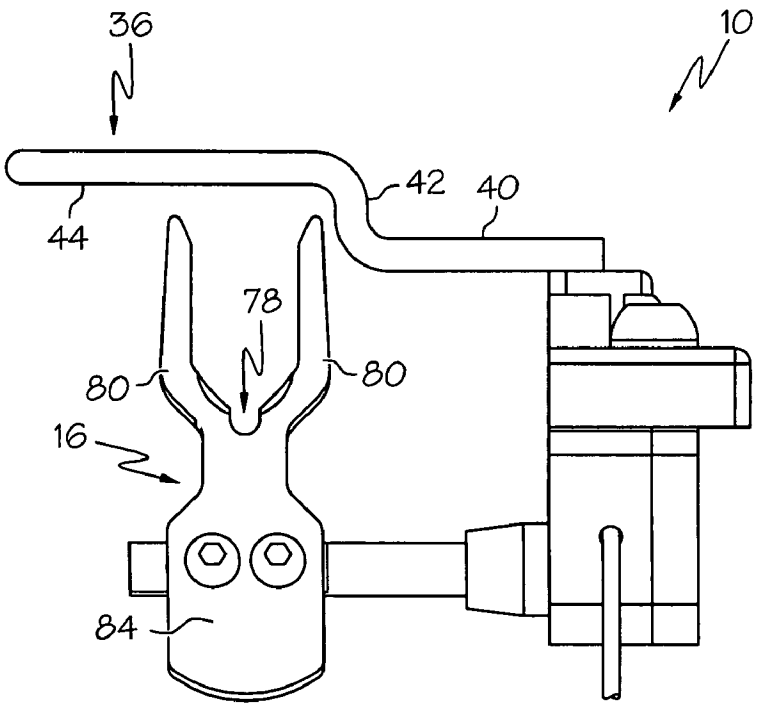

In one method of use, a user first grasps launcher 16 and rotates it upwardly from the lowered position (shown in FIGS. 3, 4 and 7B) to the upright arrow support position (shown in FIGS. 2, 6 and 7A). If containment arm 36 has been rotated away from the working position so that it does not overlap launcher 16, then an arrow 300 can be loaded onto launcher 16 in the upright arrow support position to prepare for arrow firing. Then, containment arm 36 may be swung to the working position to overlap arrow 300 positioned on launcher 16. On the other hand, if containment arm 36 is already the working position, then arrow 300 may be loaded onto launcher 16 in the lowered position prior to rotating launcher 16 to the upright arrow support position. As shown in FIG. 7B, raised lateral portions 80 and 82 of arms 74 and base 72, respectively, aid in maintaining arrow 300 on launcher 16 when arrow loading commences in the lowered position for the launcher 16. In either case, once the arrow is loaded on the launcher 16, containment arm 36 is in the working position, and launcher 16 is in the upright arrow support position, a vertical gap formed between terminal ends 75 of launcher arms 74 and containment arm 36 is preferably less than the diameter of a standard arrow 300, so that the arrow may not slip over the launcher arms 74 and fall off of the launcher 16.

Corresponding to launcher 16 being in the upright arrow support position, activator 18 is in the first position shown in FIG. 8 where body 88 has been rotated away from rotation limiting wall 104 and stop 94 has engaged with housing cavity notch 98. The user will then engage tail section 304 of arrow 300 with bow string 202 to prepare for arrow firing. As the user draws the bow string 202, to which cord 20 is attached through clip 206, stop 94 is retracted into body 88 as shown in FIG. 9. Drawing of bow string 202 must be of a sufficient magnitude for stop 94 to retract far enough to clear notch 98, and the magnitude may be selected by the user according to the location where cord 20 is clipped to bow string 202. Releasing of drawn bow string 202 releases the tension on cord 20, allowing torsional biasing element 90 to move body 88 towards rotation limiting wall 104 to the second position shown in FIG. 10. As a result of this motion, shaft 14 and launcher 16 are rotated to the lowered position. Because releasing of bow string 202 will immediately propel arrow 300 forwardly, the fact that launcher 16 begins to rotate downwardly does not significantly affect the flight path or trajectory of fired arrow 300. Launcher 16 provides the support and positioning of arrow 300 right up to the time of release of bow string 202. Launcher 16 rotates downwardly upon firing at a sufficiently fast rate as to allow arrow fletching 306 to clear launcher as arrow 300 is moving forwardly and traveling to the intended target. Containment arm 36 is configured so that arrow fletching will not contact arm 36 when traveling therebeneath upon arrow firing.

In another method of use, arrow 300 is first loaded onto launcher 16 in the lowered position. Tail section 304 of arrow 300 is also engaged with bow string 202 to prepare for firing. Drawing the bow string 202 causes cord 20 to pull on stop 84 with a force vector having a component directed radially inwardly towards shaft 14 and a component directly rearward, thereby rotating body 88 from the activator second position shown in FIG. 10 towards the position shown in FIG. 9 where stop 84 is aligned with notch 98 but remains retracted in housing 88 due to the tension on cord 20. Thus, bow string 202 drawing moves launcher from the lowered position to the upright arrow support position. The raised lateral portions 80 and 82 of arms 74 and base 72, respectively, aid in maintaining arrow 300 on launcher 16 as launcher is rotating upward to the upright arrow support position. Releasing of bow string 202 to fire arrow causes corresponding release of the tension on cord 20, enabling torsional biasing element 90 to move body 88 towards the second position shown in FIG. 10, thereby rotating shaft 14 and launcher 16 to the lowered position. With this method, stop 84 doesn't engage with notch 98 (unless the user holds launcher 16 once in the upright arrow support position and lets down bow string 202), but activator body 88 may rotate through a desired range of rotation within housing cavity 86 depending on the magnitude of motion of bow string 202 to which cord 20 is attached. In other words, activator body 88 may rotate fully from the second position shown in FIG. 10 to the position shown in FIG. 9 (corresponding with the first position but with stop 84 retracted into body 88), and then back to the second position.

Therefore, it can be seen that the fall away arrow rest 10 provides the archer with various customized features in an arrow rest for a compound bow while avoiding undesirable arrow fletching contact. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. A fall away arrow rest system for use with a compound bow having a string, the arrow rest system adapted to support a shaft of an arrow while a tail section of the arrow engages with the string for shooting of the arrow, the arrow rest comprising:

a housing having a cavity and being adapted for coupling with the bow;

a rotatable shaft having a first portion mounted with and supported by the housing and a second portion extending from the housing;

a launcher having a base affixed on the second portion of the rotatable shaft and a pair of arms extending from the base in a direction away from the rotatable shaft, the arms defining a channel therebetween for accepting the arrow shaft;

an activator disposed within the housing cavity and coupled with the rotatable shaft, the activator being operative to selectively urge rotation of the rotatable shaft and movement of the launcher from an upright arrow support position to a lowered position, and including a locking component moveable from an engaging position to releasably lock the position of the rotatable shaft when the launcher is at the upright arrow support position, and a disengaging position;

a cord secured to the locking component of the activator and extending to a point exterior of the housing for coupling with the string of the compound bow, whereby:

when the locking component is in the engaging position, pulling of the string causes movement of the cord coupled therewith to disengage the locking component, and thereafter upon releasing of the string to shoot an arrow engaging with the string and resting on the launcher, the activator moves the launcher from the upright arrow support position to a lowered position; and when the locking component is in the disengaging position and the launcher is not in the upright arrow support position, pulling of the string with a force sufficient to overcome the rotational urging of the activator causes movement of the cord coupled therewith and movement of the launcher towards the upright arrow support position.

2. The system of claim 1, wherein the activator comprises:

a body mounted onto the shaft; and a biasing means for urging rotation of the body from a first position corresponding with the upright arrow support position for the launcher to a second position corresponding with the lowered position for the launcher.

3. The system of claim 2, wherein the housing cavity includes a notch forming a contact surface, the locking component comprising:

a stop coupled with and movable with respect to the body into and out of the notch, whereby movement of the stop into the notch for engaging with the contact surface places the locking component in the engaging position and movement of the stop out of the notch places the locking component in the disengaging position; and a biasing means for urging movement of the stop into the notch, whereby pulling of the string to cause sufficient movement of the cord coupled therewith to disengage the locking component requires a pulling of the string with a sufficient force to overcome the urging of the stop into the notch provided by the biasing means.

4. The system of claim 1, further comprising a cantilevered rotatable containment arm coupled with the housing, the containment arm adapted for movement between a first position at least partially overlying the launcher and second position substantially perpendicular to the rotatable shaft.

5. The system of claim 4, wherein the first position forms a gap between cantilevered rotatable containment arm and the arms of the launcher that is less than the diameter of the arrow shaft, and the second position places the entire cantilevered rotatable containment arm above the housing.

6. The system of claim 1, wherein the housing comprises:

a mounting component for coupling directly to the compound bow;

an intermediate component; and a support component with which the rotatable shaft is mounted and having the cavity in which the activator is disposed.

7. The system of claim 6, further comprising:

a lateral adjustment means coupling the intermediate component with the support component of the housing for selectively positioning the launcher at a specific lateral distance from the compound bow when the housing is coupled to the bow; and a vertical adjustment means coupling the mounting component with the intermediate component of the housing for selectively positioning the launcher at a specific vertical location relative to the compound bow when the housing is coupled to the bow and the bow is in the upright, vertical position.

* * * * *